US009683388B2

(12) United States Patent
Ohl et al.

(10) Patent No.: US 9,683,388 B2
(45) Date of Patent: Jun. 20, 2017

(54) LOCK RE-PINNING FIXTURE

(71) Applicant: Schlage Lock Company LLC, Indianapolis, IN (US)

(72) Inventors: James D. Ohl, Colorado Springs, CO (US); Peter Malenkovic, Monument, CO (US); Raymond H. Lammers, Colorado Springs, CO (US)

(73) Assignee: Schlage Lock Company LLC, Indianapolis, IN (US)

( * ) Notice: Subject to any disclaimer, the term of this patent is extended or adjusted under 35 U.S.C. 154(b) by 237 days.

(21) Appl. No.: 14/214,494

(22) Filed: Mar. 14, 2014

(65) Prior Publication Data

US 2014/0260460 A1 Sep. 18, 2014

Related U.S. Application Data

(60) Provisional application No. 61/785,822, filed on Mar. 14, 2013.

(51) Int. Cl.
*E05B 17/00* (2006.01)
*E05B 27/00* (2006.01)

(52) U.S. Cl.
CPC ..... *E05B 17/0004* (2013.01); *E05B 27/005* (2013.01); *Y10T 70/8432* (2015.04)

(58) Field of Classification Search
CPC ..... E05B 27/0007; E05B 63/0065; E05B 17/0004; E05B 27/0003; E05B 27/0017; E05B 27/00; E05B 35/125; E05B 17/00; E05B 25/00; E05B 9/04; E05B 27/005; Y10T 70/8432
USPC ..... 70/490–493, 367–372, 375, 378, 379 R, 70/466, 382, 384
See application file for complete search history.

(56) References Cited

U.S. PATENT DOCUMENTS 1,564,463 A * 12/1925 Ellison ..... E05B 17/04 70/357
3,111,748 A * 11/1963 Doll ..... E05B 17/0004 29/434
3,218,699 A * 11/1965 Maese ..... E05B 17/0004 29/423
3,417,452 A * 12/1968 Roland ..... B21D 53/42 29/436
3,664,007 A * 5/1972 Schlage ..... E05B 17/0004 29/271
4,068,510 A * 1/1978 Neary ..... E05B 9/105 70/379 R
4,672,828 A * 6/1987 Theriault ..... E05B 63/0065 70/373
4,680,860 A * 7/1987 Detloff ..... B25B 1/20 29/281.1

(Continued)

*Primary Examiner* — Suzanne Barrett
(74) *Attorney, Agent, or Firm* — Taft Stettinius & Hollister LLP

(57) ABSTRACT

An exemplary lock re-pinning fixture includes a first housing releasably joined with a second housing, and a follower bar positioned at least partially in the second housing. The follower bar may be structured for a plurality of orientations within the housings, and may be biased toward the first housing. The first housing may be configured to receive a lock cylinder such that the plug of the cylinder is aligned with the follower bar. Further embodiments, forms, features, aspects, benefits, and advantages of the present application shall become apparent from the description and figures provided herewith.

19 Claims, 10 Drawing Sheets

(56) References Cited

U.S. PATENT DOCUMENTS 4,914,932 A * 4/1990 Walla ..... E05B 9/086 70/367
5,609,052 A * 3/1997 Denning ..... E05B 9/04 29/464
5,628,109 A * 5/1997 Neuman ..... E05B 17/0004 29/270
5,921,122 A * 7/1999 Lin ..... E05B 27/005 70/368
6,021,655 A * 2/2000 Labbe ..... E05B 17/0004 29/281.1
6,109,080 A * 8/2000 Chen ..... E05B 9/084 70/215
6,623,051 B2 * 9/2003 Bonora ..... H01L 21/67373 292/330
6,640,592 B2 * 11/2003 Vickers ..... E05B 17/04 292/64
6,644,076 B2 * 11/2003 Huang ..... E05B 17/04 70/367
6,722,171 B1 * 4/2004 Ruan ..... E05B 17/04 70/371
6,758,075 B1 * 7/2004 Thwing ..... E05B 11/00 70/372
6,978,645 B2 * 12/2005 Shimon ..... E05B 17/0058 70/379 R
7,146,833 B2 * 12/2006 Ramsauer ..... E05B 17/04 70/367
7,685,852 B2 * 3/2010 Komemi ..... E05B 17/0004 29/464
7,685,853 B2 * 3/2010 Burkart ..... E05B 17/0004 29/464
7,895,865 B2 * 3/2011 Hartman ..... E05B 17/04 70/1.5
7,905,124 B2 * 3/2011 Komemi ..... E05B 19/20 29/804
8,881,567 B2 * 11/2014 Chong ..... E05B 29/004 29/804
9,169,667 B1 * 10/2015 O'Neill ..... E05B 17/0004
2014/0250959 A1 * 9/2014 Tsai ..... E05B 47/0044 70/491
2014/0260460 A1 * 9/2014 Ohl ..... E05B 17/0004 70/447
2015/0047400 A1 * 2/2015 Raty ..... E05B 5/003 70/491
2015/0259948 A1 * 9/2015 Malenkovic ..... E05B 17/0004 70/447

* cited by examiner

LOCK RE-PINNING FIXTURE

CROSS REFERENCE TO RELATED APPLICATIONS

The present application claims the benefit of U.S. Provisional Patent Application No. 61/785,822, filed Mar. 14, 2013, the contents of which are incorporated herein by reference in their entirety.

BACKGROUND

Re-pinning a cylinder lock can pose substantial issues. Persons that are inexperienced or inattentive to the task may easily and unintentionally at least partially disassemble the lock by ejecting one or more pins that are not intended to be removed. This may require specialized tools or training to reassemble, resources that simply may not be readily available. This results in a difficult and time consuming task that, the consumer often foregoes in favor of returning the disassembled lock to the manufacturer as damaged goods. These issues may be of particular importance to lock manufacturers, who may receive these otherwise operational locks as a damaged product returned for a refund. Accordingly, there is a significant need for the unique and inventive apparatuses, methods and systems for a lock re-pinning fixture as disclosed herein.

SUMMARY

Unique apparatuses, methods, and systems of a lock re-pinning fixture are disclosed. An exemplary fixture is provided with a first housing releasably joined with a second housing, and a follower bar positioned at least partially in the second housing. The follower bar may be structured for a plurality of orientations within the housings, and may be biased toward the first housing. The first housing may be configured to receive a lock cylinder such that the plug of the cylinder is aligned with the follower bar. Further embodiments, forms, features, aspects, benefits, and advantages of the present application shall become apparent from the description and figures provided herewith.

DETAILED DESCRIPTION OF ILLUSTRATIVE EMBODIMENTS

Figure 1:
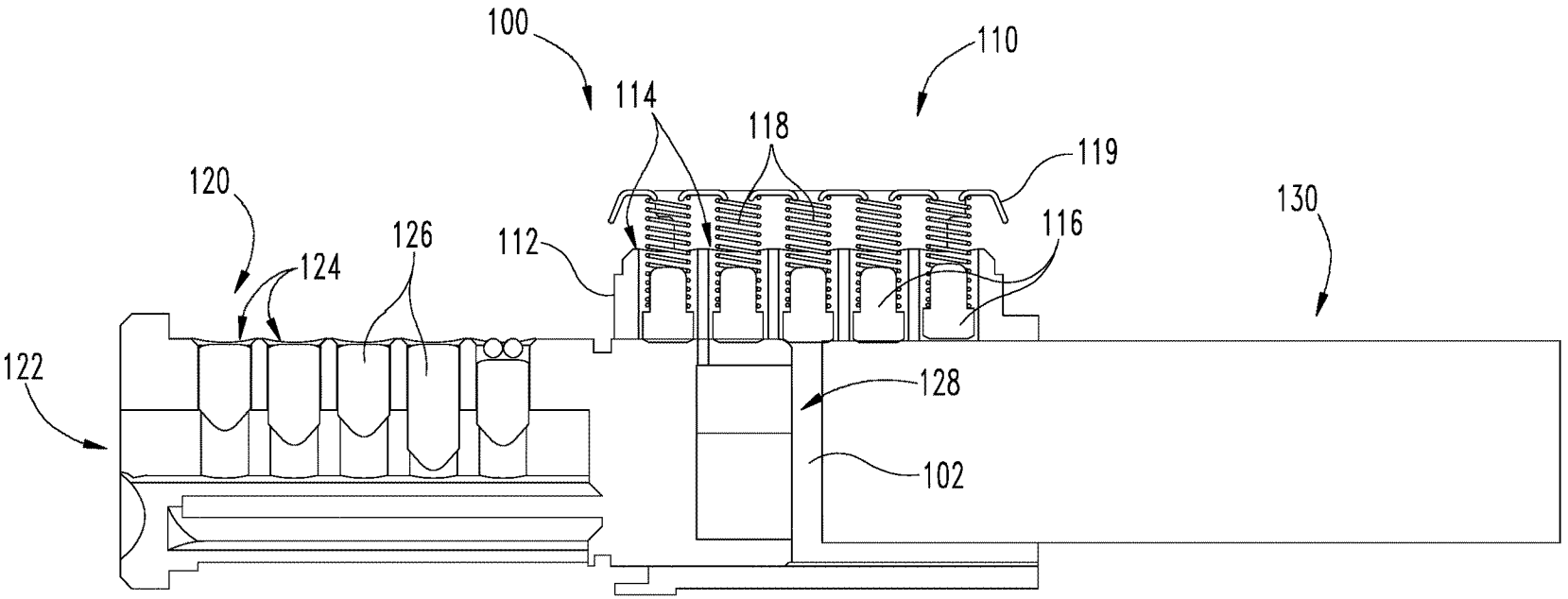
Fig. 1 (PRIOR ART)
FIG. 1 depicts a lock cylinder and follower bar during a conventional re-pinning event.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

With reference to FIG. 1, a lock cylinder 100 and follower bar 130 are depicted during a conventional re-pinning operation. The lock cylinder 100 includes a shell 110 including a cavity, and a plug 120 positioned in the cavity. The shell 110 includes a tower 112 defining a plurality of top pin chambers 114, and a plurality of top pins 116 positioned in the chambers 114. The lock plug 120 includes a keyway 122, a plurality of bottom pin chambers 124, and a plurality of bottom pins 126 positioned in the chambers 124. The lock cylinder 100 also includes a plurality of biasing elements or springs 118, which are positioned in the tower 112 and bias the top pins 116 toward the plug 120. When the lock cylinder 100 is assembled, the plug body 120 is positioned in a cavity formed in the shell 110, and the top pins 116 are captured by the shell 110 such that the top pins 116 retained at least partially within the chambers 114. For example, a cap 119 may prevent the top pins 116 from escaping the tower 112 in a radially outward direction, and the body of the plug 120 or the bottom pins 126 may prevent the top pins 116 from escaping the tower 112 in a radially inward direction.

In order to re-pin the cylinder 100, the plug 120 must be removed from the shell 110 such that one or more of the bottom pins 126 can be replaced and/or rearranged for recombinating. When the plug 120 is removed from the shell 110, the pin springs 118 will tend to eject the top pins 116 from the shell chambers 114 and into the cavity in the shell 110. This ejection is often referred to as "exploding", and the resulting state of the cylinder 100 is often referred to as a "blown" condition.

In order to prevent the cylinder 100 from exploding, conventional re-pinning operations commonly include inserting the follower bar 130 into the shell 110 as the plug 120 is removed, such that the follower bar 130 takes the place of the plug 120 and retains the top pins 116 within the tower 112. The follower bar 130 is inserted into the shell 110 at the same rate as the lock plug 120 is removed from the shell 110, such that a contacting interface between the follower bar 130 and an end 128 of the plug 120 is maintained as the plug 120 slides out of and is removed from the shell 110. If the person performing the re-pinning is inexperienced or inattentive to the task of inserting the follower bar 130, a gap 102 may form between the follower bar 130 and the plug 120. When the gap 102 occurs, one or more of the top pins 116 may be ejected from the pin chambers 114 and into the gap 102, resulting in a blown condition of the cylinder 100. Without proper training and locksmith tools, the task of properly reassembling a cylinder 100 in the blown condition is difficult and time consuming.

Figure 2:
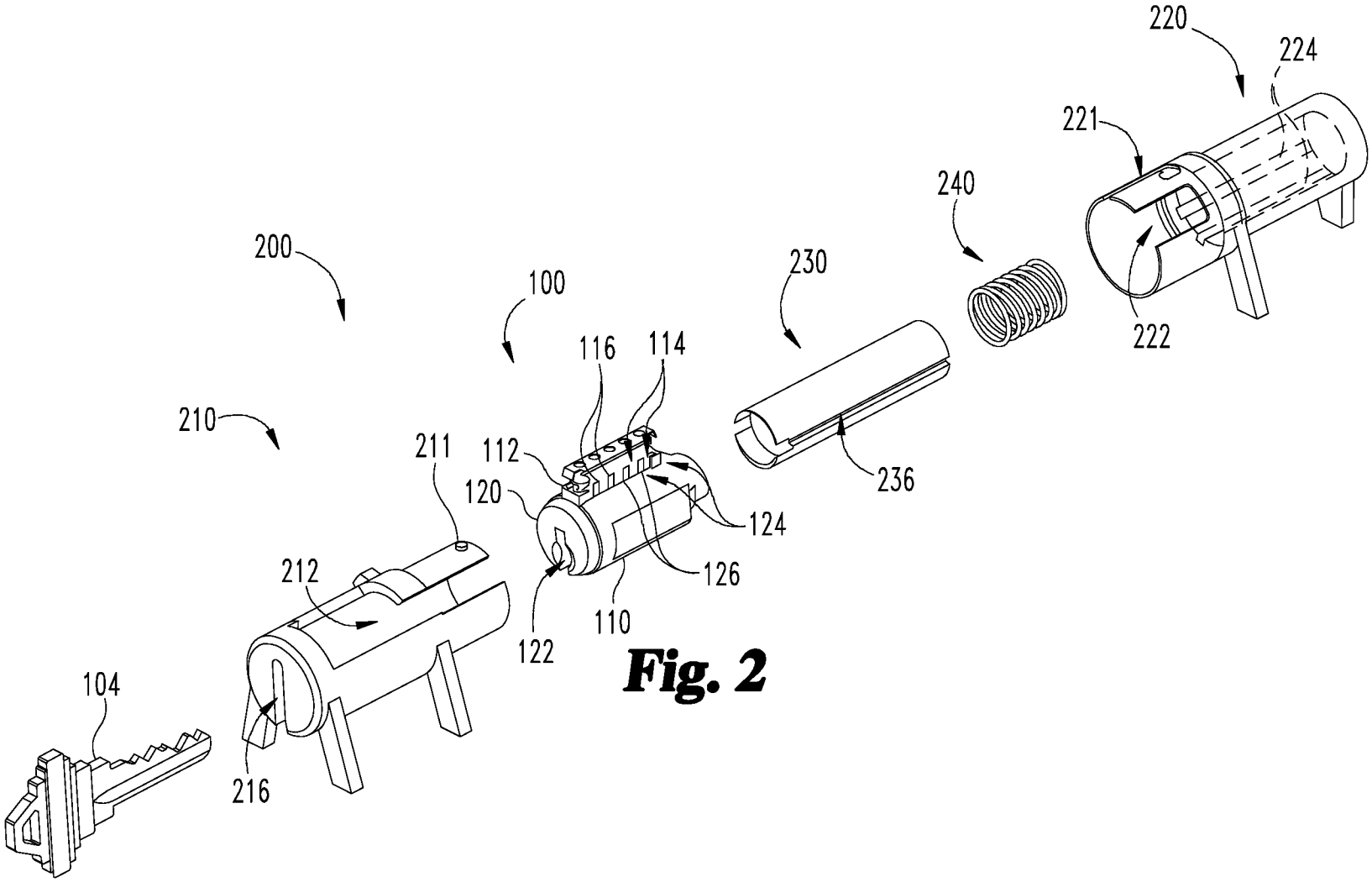
FIG. 2 is an exploded assembly view of the lock cylinder with an exemplary lock re-pinning fixture according to an embodiment of the invention.
Figure 3:
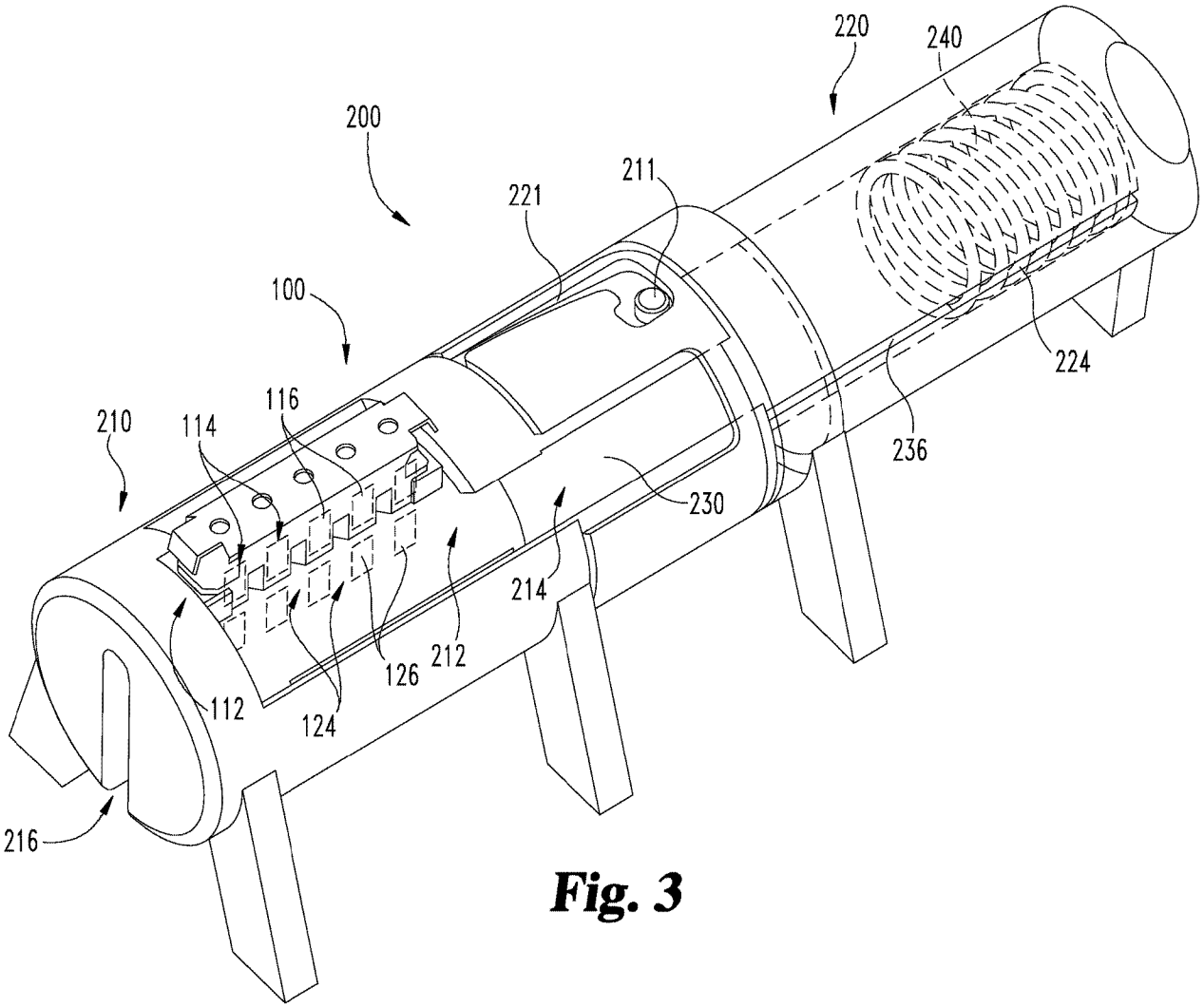
FIG. 3 is an illustration of the assembled exemplary lock re-pinning fixture with the lock cylinder in a first configuration.
Figure 4:
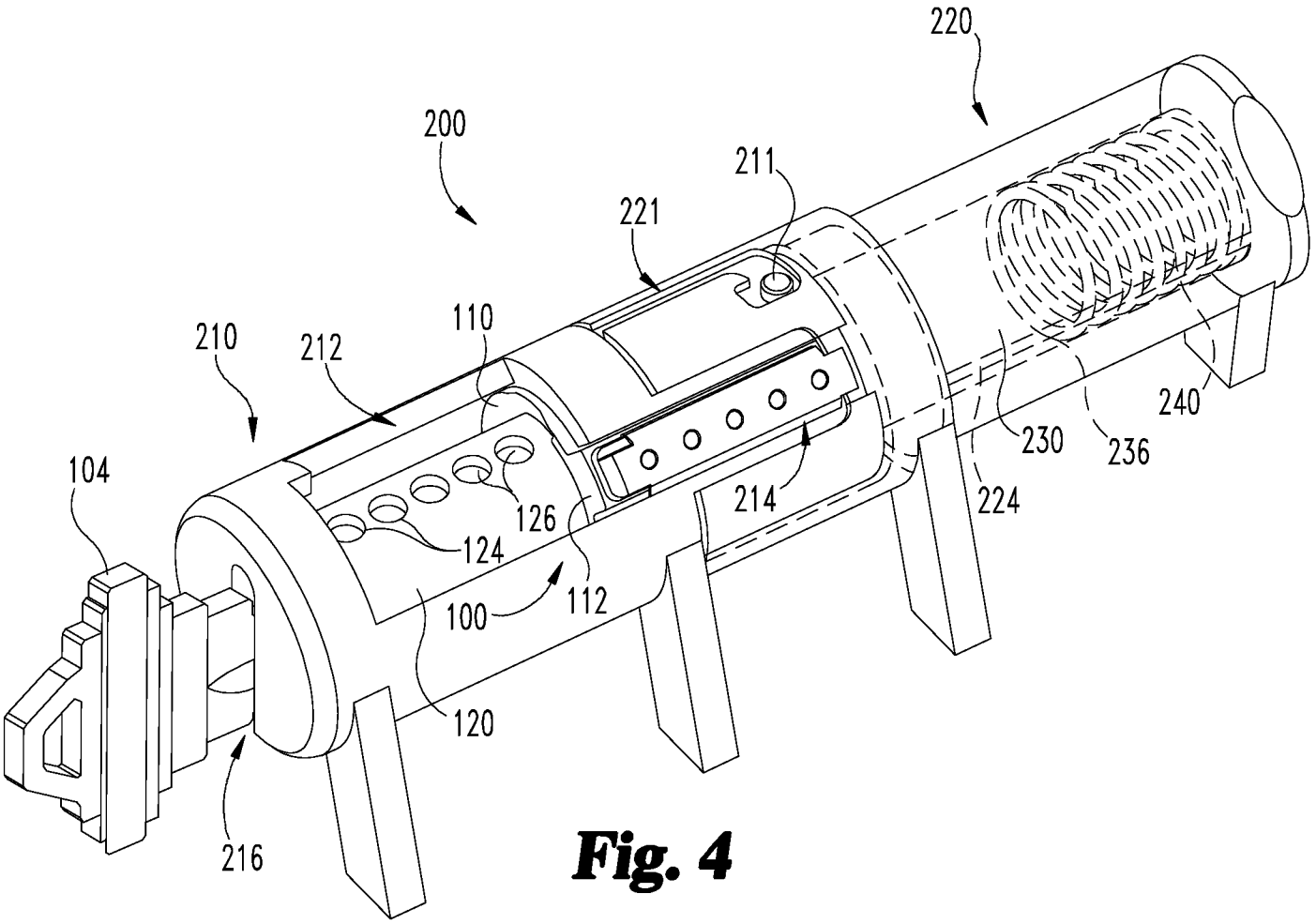
FIG. 4 is an illustration of the assembled exemplary lock re-pinning fixture with the lock cylinder in another configuration.

FIGS. 2-4 depict the lock cylinder 100 and an exemplary lock re-pinning fixture 200 in a variety of configurations. FIG. 2 illustrates an exploded assembly view of the fixture 200, along with the lock cylinder 100 and a key 104. FIG. 3 depicts the assembled fixture 200 with the lock cylinder 100 in a first configuration. FIG. 4 depicts the assembled fixture 200 with the lock cylinder 100 in another configuration. As best seen in FIG. 2, the lock re-pinning fixture 200 includes a front housing 210, a rear housing 220, a follower bar 230, and a biasing element or spring 240.

FIG. 3 depicts the assembled lock re-pinning fixture 200 with the lock cylinder 100 in a first configuration. In the first configuration, the lock cylinder 100 is still substantially assembled, with the top and bottom pins 116, 126 captured or contained by the shell 110 and the plug 120. The lock cylinder 100 is positioned in the front housing 210, and the follower bar 230 and spring 240 are positioned primarily in the rear housing 220. The follower bar 230 may include channels 236 which receive internal splines 224 formed in the rear housing 220. The housings 210, 220 are releasably coupled to one another, for example via bayonet attachment features, depicted herein as a post 211 and a hooked channel 221. It is also contemplated that additional or alternative mounting or joining features may be incorporated.

When the lock re-pinning fixture 200 is assembled with the lock cylinder 100, the lock cylinder 100, the follower bar 230, and the spring 240 are retained within the front and rear housings 210, 220. The follower bar 230 is positioned between the lock cylinder 100 and the spring 240, such that the spring 240 biases the follower bar 230 against the lock plug 120 to prevent formation of a gap. This biasing force effectively couples the lock plug 120 and follower bar 230, such that the lock plug 120 and follower bar 230 are stationary with respect to one another. As a result, any axial movement of the lock plug within the fixture 200 may be mimicked by the follower bar 230, maintaining a tight contact between the two elements.

FIG. 4 depicts the assembled lock re-pinning fixture 200 with the lock cylinder 100 in another configuration. The front housing 210 is provided with an opening 216 to allow the key 104 to be inserted through the front housing 210 and into the plug 120. When inserted, the key 104 retains the lock plug 120 at a fixed rotational position, keeping the plug 120 properly aligned and substantially stationary within the fixture 200. Additionally, when the key 104 is inserted, the pins 116, 126 are aligned with a shear line of the cylinder 100, such that the shell 110 is rotationally and axially movable with respect to the plug 120. The front and rear housings 210, 220 may have respective openings 212, 222 to accommodate the tower 112 as the shell 110 rotationally and axially moves with respect to the plug 120. When the housings 210, 220 are joined together, the openings 212, 222 form a channel 214 operable to receive the tower 112, such that the shell 110 is axially movable with respect to the fixture 200.

In order to perform the re-pinning operation, the lock cylinder 100 is placed in the front housing 210, preferably in a locked state to keep the lock cylinder 100 assembled. With the follower bar 230 and spring 240 positioned in the rear housing 220, the two housings 210, 220 may be joined or mounted together and secured with the bayonet attachment features 211, 221. The lock cylinder 100 is placed in a first configuration (FIG. 3) including a first plug position and a first shell position. In the first cylinder configuration, the shell 110 is positioned on the plug 120, the tower 112 is substantially vertical, and the plug keyway 122 is aligned with the opening 216. While the lock cylinder 100 is still locked and in this first configuration, the top and bottom pins 116, 126 are retained in the chambers 114, 124, and the pin springs 118 bias the top pins 116 against the bottom pins 126.

When the lock cylinder 100 is in the first configuration, the key 104 may be inserted into the plug 120 through the opening 216, aligning the top and bottom pins 116, 126 with the shear line of the lock cylinder 100, allowing the shell 110 to rotate with respect to the plug 120. The cylinder 100 is then placed in a second configuration (not illustrated) by rotating the shell 110 about the lock plug 120 to a second shell position, while the plug 120 remains in the first plug position. In the illustrated embodiment, the second shell position is offset from the first shell position by approximately 45°, although other offset angles are contemplated as within the scope of the present invention. When the shell 110 is in the second shell position, the top pins 116 are captured within the pin chambers 114 and are biased into contact with the lock plug 120 by the springs 118, and the bottom pins 126 are retained within the pin chambers 124 between the key 104 and the shell 110.

Once the shell 110 has been rotated to the second position, the tower 112 is aligned with the channel 214, and the shell 110 is axially movable with respect to the plug 120. The cylinder 100 is then placed in a third configuration (FIG. 4) by pushing the shell 110 toward the rear housing 220, such that the shell 110 axially moves to a third shell position. As the shell 110 moves from the second shell position to the third shell position, the shell 110 slides off of the plug 120 and onto the follower bar 230. Because the spring 240 biases the follower bar 230 against the lock plug 120, the shell 110 may move from the second shell position to the third shell position without any of the top pins 116 being ejected from their respective pin chambers 114. In the third shell position, the top pins 116 are retained within their respective pin chambers 114 between the springs 118 and the follower bar 230. Additionally, in the third configuration of the cylinder 100, the bottom pin chambers 124 are exposed, allowing the bottom pins 126 to be moved and/or replaced for recombinating the lock cylinder 100. Once the bottom pins 126 have been replaced, the above-described steps may be followed in reverse to reassemble the lock cylinder 100.

It is appreciated that the outer edges and general cross-sectional profile of the follower bar 230 and the lock plug 120 may be substantially congruent to provide a smooth transition for the top pins 116 as they travel along the outer surfaces of the plug 120 and the follower bar 230, such that the top pins 116 are retained within the pin chambers 114. In addition, it is appreciated that the inner diameter of the shell 110 may correspond to the outer diameter of the follower bar 230, enabling the shell 110 to easily and smoothly translate over and along the follower bar 230 without interference. When the fixture 200 is assembled with the lock cylinder 100, the lock plug 120 and the follower bar 230 may share a common longitudinal axis, such that the two parts work in unison to maintain the alignment of the shell 110 with respect to the lock plug 120 throughout the re-pinning process.

FIGS. 5*a*, 5*b*, 6*a*, 6*b*, 7*a* and 7*b* depict an exemplary follower bar 330 in various orientations, along with a variety of illustrative lock plugs 520, 620, 720. The follower bar 330 may, for example, be utilized in the lock re-pinning fixture 200, such that the fixture 200 is operable with a variety of forms of lock plug without requiring a separate follower bar for each of the plugs 520, 620, 720.

Figure 5A:
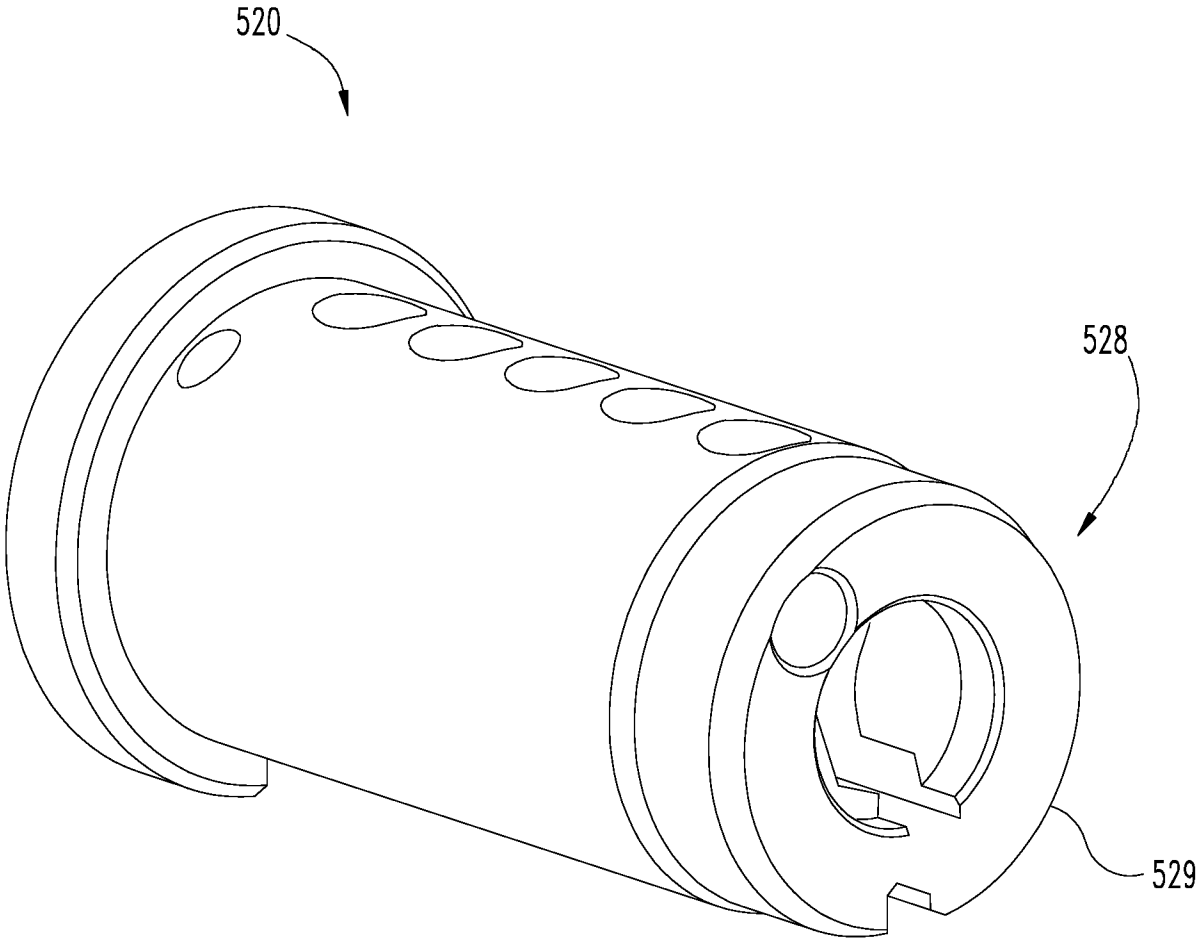
FIGS. 5*a*, 5*b*, 6*a*, 6*b*, 7*a* and 7*b* depict a follower bar according to another embodiment of the invention with various embodiments of lock plugs.
Figure 5B:
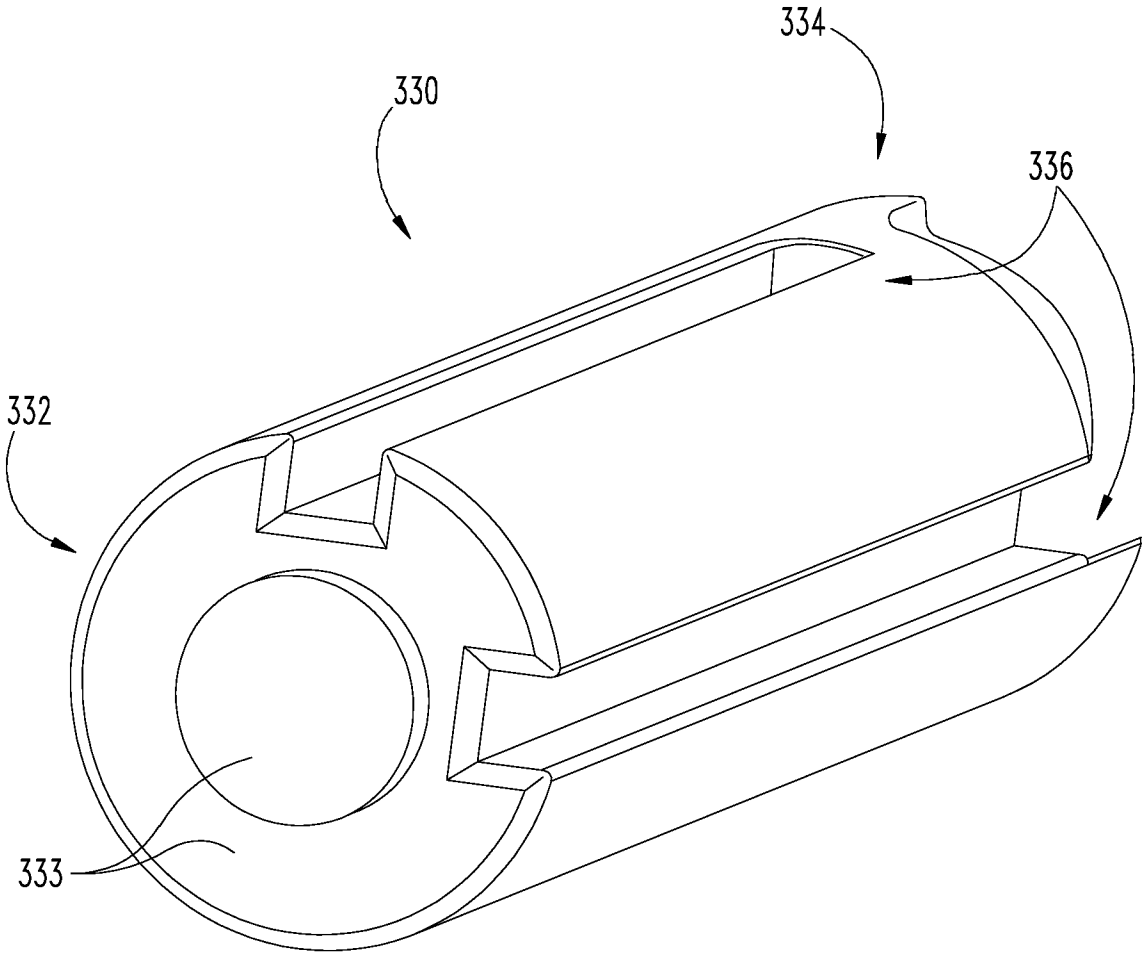

With reference to FIGS. 5*a* and 5*b*, the follower bar 330 is shown in a first orientation, along with a first illustrative lock plug 520 including an end 528 with a substantially circular portion 529. The follower bar 330 has a first end 332 including features 333 which matingly engage the circular portion 529, such that the plug end 628 may be smoothly accepted into the follower bar first end 332. The mating engagement between the plug end 528 and the follower bar first end 332 ensures proper contact between the follower bar 330 and the lock plug 520 during a re-pinning operation such as that described above.

Figure 6A:
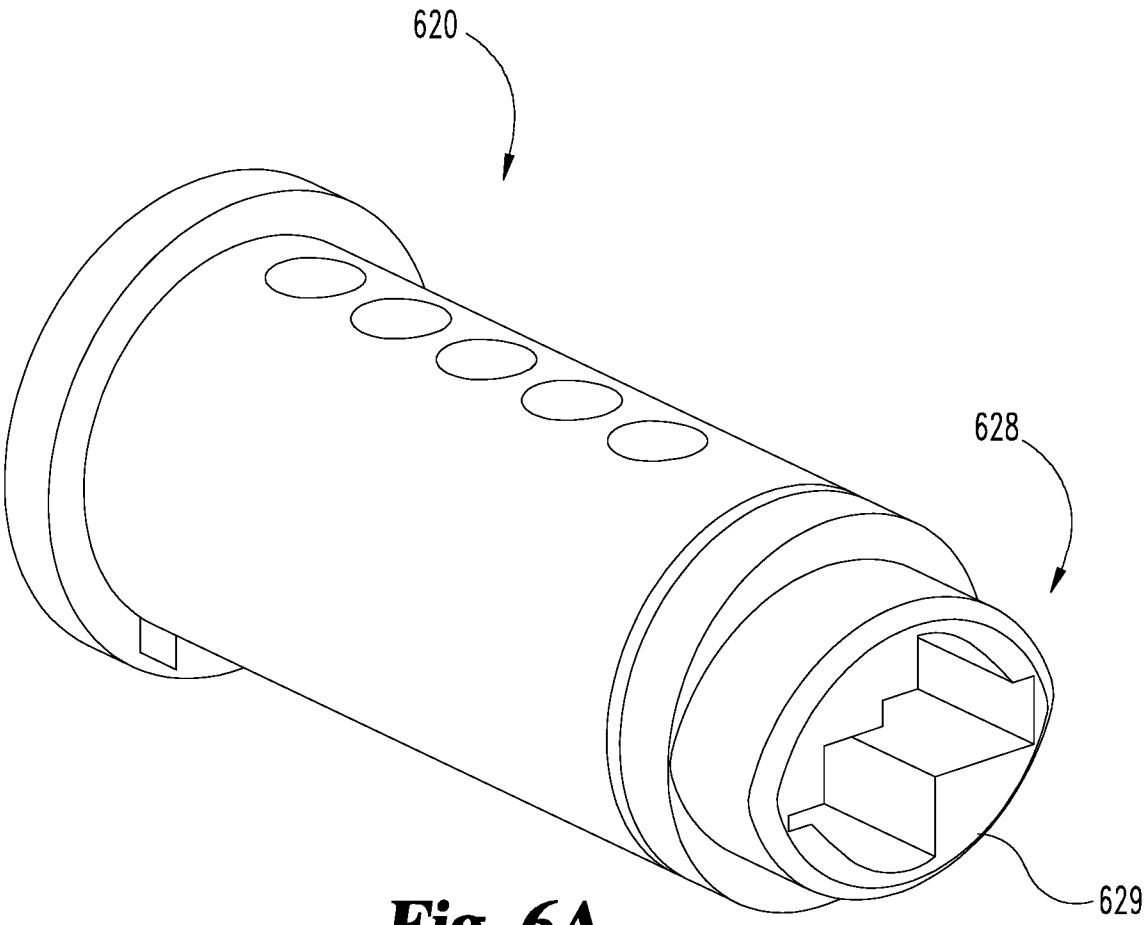
Figure 6B:
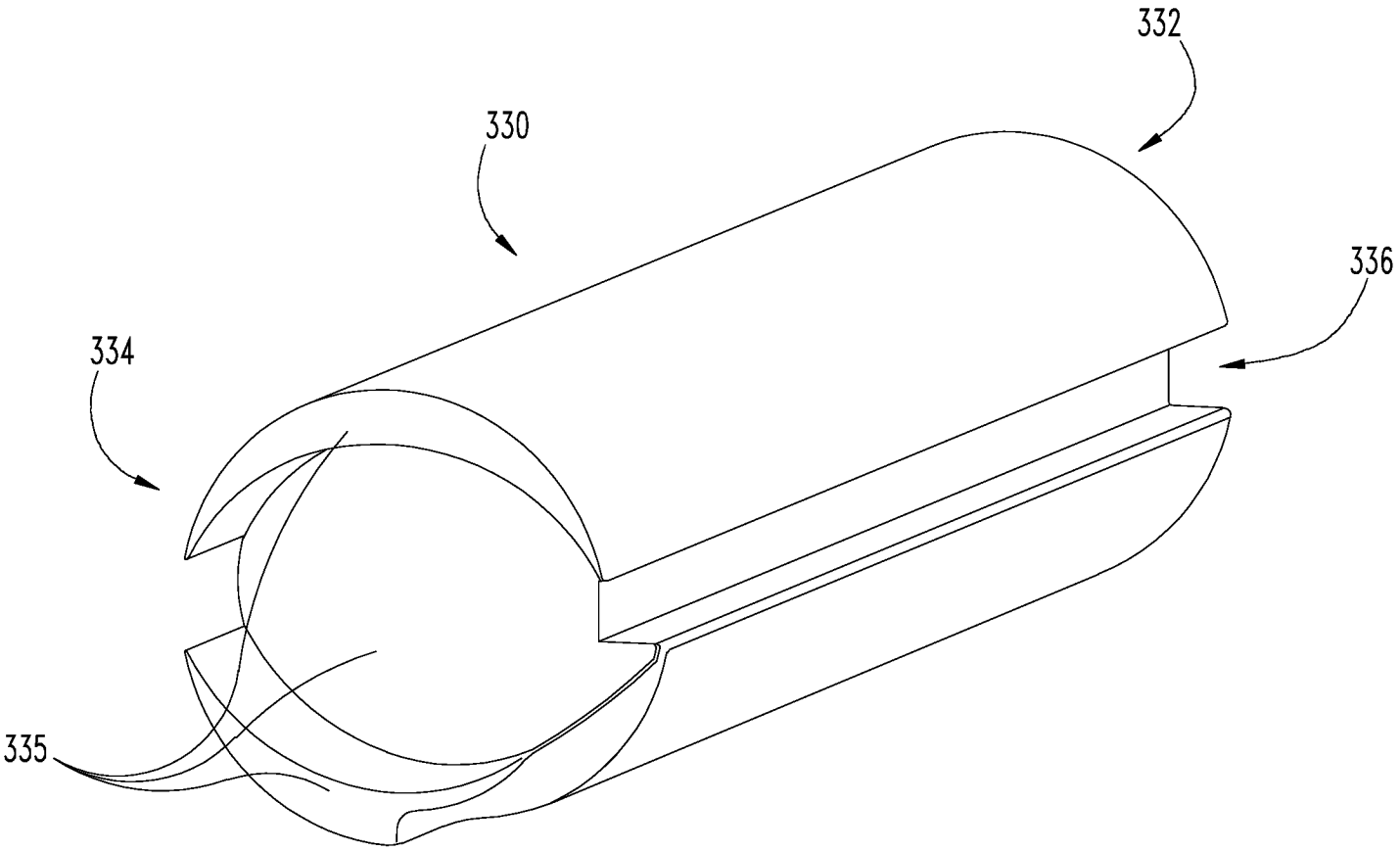

With reference to FIGS. 6*a* and 6*b*, the follower bar 330 is shown in a second orientation, with a second end 334 of the follower bar 330 being shown in detail. In addition, a second illustrative lock plug 620 having an end 628 with a generally elliptical portion 629 is shown. The follower bar second end 334 includes features 335 which, when the follower bar 330 is in the second orientation, may matingly engage the elliptical portion 629, such that the plug end 628 may be smoothly accepted into the follower bar second end 334. The mating engagement between the plug end 628 and the follower bar second end 334 ensures proper contact between the follower bar 330 and the lock plug 620 during a re-pinning operation such as that described above.

Figure 7A:
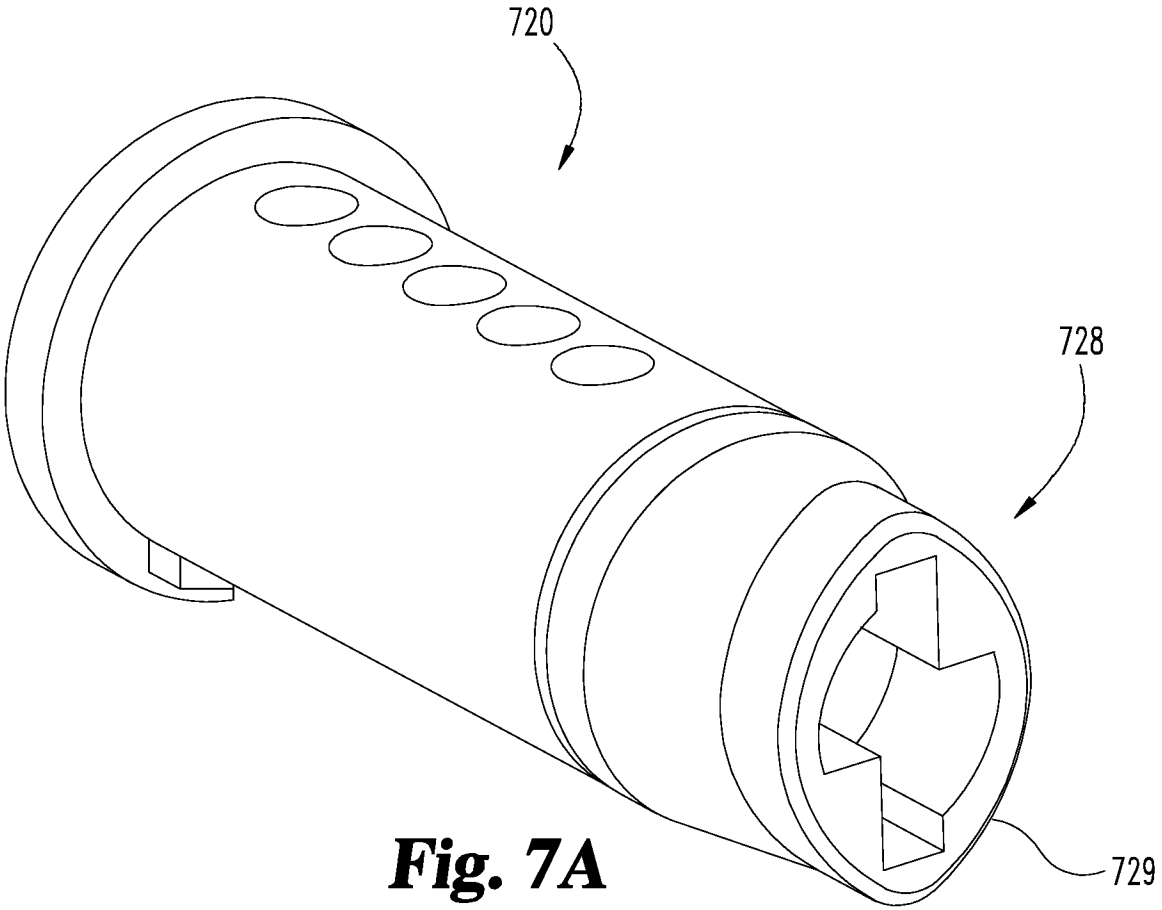
Figure 7B:
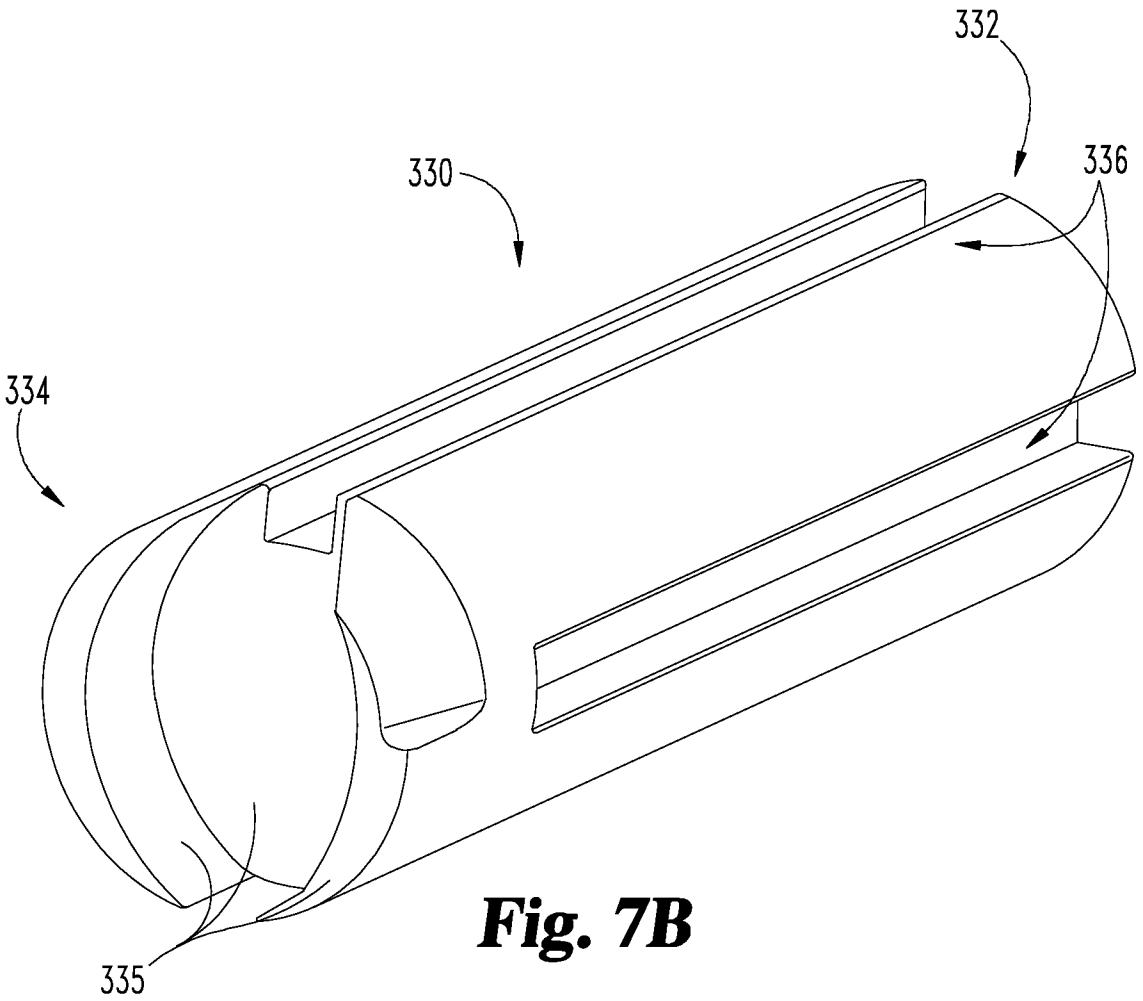

With specific reference to FIGS. 7*a* and 7*b*, the follower bar 330 is shown in a third orientation, with a third illustrative lock plug 720 having an end 728 including a generally elliptical portion 729. The plug end 728 may be substantially similar to the previously-described plug end 628, but the elliptical portion 729 is offset by an angle of approximately 90° when compared to the previously-described elliptical portion 629. As such, the third orientation of the follower bar 330 is offset by an angle of approximately 90° with respect to the second orientation, such that the features 335 may matingly engage the elliptical portion 729 to enable the plug end 728 to be smoothly accepted into the follower bar second end 334. The mating engagement between the plug end 728 and the follower bar second end 334 ensures proper contact between the follower bar 330 and the lock plug 720 during a re-pinning operation such as that described above.

With additional reference to FIGS. 5*b*, 6*b* and 7*b*, the follower bar 330 may be include one or more channels or key ways 336 that correspond to one or more internal splines or keys 224 formed in the rear housing 220 (FIGS. 3 and 4). These splines 224 and channels 336 may cooperate to facilitate insertion of the follower bar 330 in an orientation corresponding to the plug 120 of the cylinder 100 which is to be re-pinned. Such multiple orientations allow for a single follower bar 330 to be engageable with a multitude of different forms of the lock cylinder 100 and plug 120. It is appreciated that while the channels 336 are shown in the follower bar 330 and the splines 224 are described as being formed in the rear housing, the relative positions of these features may be reversed. Furthermore, other appropriate alignment features may be utilized.

Referring back to FIGS. 2-4, it is appreciated that the lock re-pinning fixture 200 may be provided as a kit with multiple follower bars 230, each being suitable for use in one or more orientations within the rear housing 220. A kit may include a single front housing 210, a single rear housing 220, a single spring 240, and multiple follower bars 230, such that the kit is operable with a multitude of different forms of the lock cylinder 100 and plug 120. Each of the follower bars 230 may be capable of multiple orientations corresponding to different forms of the plug 120, for example as described above with respect to the follower bar 330.

One aspect of the present disclosure provides a system having a front housing mounted to a rear housing. A lock assembly is removably housed in the front housing, and has a lock body and a lock core. A biasing element is mounted in the rear housing and a follower bar is housed in the rear housing. The biasing element biases the follower bar against the lock core, with the follower bar and the lock core being stationary with respect to one another.

A refinement of the present disclosure provides that the follower bar is structured for multiple orientations within the rear housing.

Another refinement of the present disclosure provides that the follower bar has one or more end features matingly engageable with the lock assembly.

Yet another refinement provides that the front housing and the rear housing are removably mounted via bayonet attachment features.

Another refinement provides one or more top pins housed in the lock body and one or more bottom pins housed in the lock core, the lock body having at least a first position with respect to the lock core wherein the one or more top pins and the one or more bottom pins are contained by the lock body and the lock core. Yet another refinement provides that the lock body has at least a second position with respect to the lock core, with the one or more top pins being contained by the lock body and the follower bar. Another refinement provides that the lock body has at least a second position with respect to the lock core, with the one or more bottom pins being exposed.

Another aspect of the present disclosure provides a fixture structured for re-pinning a lock assembly. The fixture is provided with a first housing mounted to a second housing, with the first housing and the second housing being in communication with one another. A follower bar is removably housed within the second housing. The follower bar is structured for a plurality of orientations within the second housing.

A refinement of the present disclosure provides that the first housing is received at least partially within the second housing.

Another refinement provides that the second housing comprises one or more internal keys, and the follower bar comprises a plurality of external key ways. Another refinement provides that the plurality of key ways is engageable with the one or more keys in a plurality of combinations.

Yet another refinement of the present disclosure provides a biasing element mounted within the second housing, the biasing element biases against the follower bar.

Another refinement provides that one or more of the first housing, the second housing, and the follower bar are generally cylindrical.

Yet another refinement provides that the biasing element biases the follower bar toward the first housing Yet another aspect of the present disclosure provides a first housing removably mounted to a second housing. A lock assembly has a lock plug and an outer casing, the lock assembly being removably mounted in the first housing. A biasing element is housed in the second housing. A first bar is housed in the second housing and the biasing element biasing the first bar toward the first housing. The first bar has a plurality of key ways and the second housing has one or more keys, the key ways being structured for a plurality of engagement orientations with the keys.

A refinement of the present disclosure provides that the first bar and the lock plug are stationary with respect to one another.

Another refinement of the present disclosure provides that the first bar has at least one structural end feature matingly engageable with the lock plug.

Yet another refinement provides a second bar that is interchangeable with the first bar.

Another refinement provides a plurality of top pins housed in the outer casing, and a plurality of bottom pins housed in the lock plug. The outer casing has at least a first position with respect to the lock plug wherein the plurality of top pins and the plurality of bottom pins are captured by the outer casing and the lock plug. Another refinement provides that the outer casing has at least a second position with respect to the lock plug wherein the plurality of top pins is captured by the outer casing and the first bar. Yet another refinement provides that the outer casing has at least a second position with respect to the lock plug wherein the plurality of bottom pins is removable.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A system, comprising:

a front housing mounted to a rear housing;

a lock assembly removably housed in said front housing, and comprising a lock body and a lock core;

one or more top pins housed in said lock body;

one or more bottom pins housed in said lock core;

a biasing element mounted in said rear housing; and a follower bar removably housed in said rear housing;

wherein said biasing element biases said follower bar against said lock core, said follower bar and said lock core being stationary with respect to one another;

said lock body having plurality of positions with respect to the lock core, the plurality of positions comprising:

a first position in which said one or more top pins and said one or more bottom pins are contained by said lock body and said lock core; and a second position in which said one or more top pins are contained by said lock body and said follower bar.

2. The system of claim 1, wherein said follower bar is structured for multiple orientations within said rear housing.

3. The system of claim 1, wherein said follower bar comprises one or more end features matingly engageable with said lock assembly.

4. The system of claim 1, wherein said front housing and said rear housing are removably mounted via bayonet attachment features.

5. The system of claim 1, wherein the plurality of positions further comprises a third position in which said one or more bottom pins are exposed.

6. A fixture structured for re-pinning a lock assembly comprising:

a first housing having a first housing interior mounted to a second housing having a second housing interior;

said first housing interior and said second housing interior being in communication with one another when said first housing is mounted to said second housing;

a follower bar removably housed within said second housing interior, wherein said follower bar extends in a longitudinal direction and includes a first end having a first geometry and an opposite second end having a second geometry different from said first geometry, wherein each of the first geometry and the second geometry comprises a flat surface and at least one longitudinal protrusion; and wherein said follower bar is structured for a plurality of orientations within said second housing interior.

7. A fixture structured for re-pinning a lock assembly comprising:

a first housing mounted to a second housing;

said first housing and said second housing being in communication with one another, wherein said first housing is received at least partially within said second housing;

a follower bar removably housed within said second housing, wherein the follower bar comprises a first end and an opposite second end, and wherein the first end of the follower bar comprises a recess having an elliptical cross-section; and wherein said follower bar is structured for a plurality of orientations within said second housing, and wherein the second end of the follower bar comprises a protrusion having a circular cross-section.

8. The fixture of claim 6, wherein said second housing interior and said follower bar include one or more keys that are selectively engaged with a plurality of key ways to provide said plurality of orientations of said follower bar within said second housing interior.

9. The fixture of claim 8, wherein said plurality of key ways are defined by said follower bar, and wherein said one or more keys are defined by said second housing interior.

10. A fixture structured for re-pinning a lock assembly comprising:

a first housing mounted to a second housing;

said first housing and said second housing being in communication with one another;

a follower bar removably housed within said second housing; and a biasing element mounted within said second housing, said biasing element biases against said follower bar; and wherein said follower bar is structured for a plurality of orientations within said second housing.

11. The fixture of claim 10, wherein said biasing element biases said follower bar toward said first housing.

12. A system, comprising:

a first housing removably joined to a second housing;

a lock assembly comprising a lock plug and an outer casing, said lock assembly being removably mounted in said first housing;

a biasing element housed in said second housing;

a first follower bar housed in said second housing and said biasing element biasing said first follower bar toward said first housing; and wherein said first follower bar comprises a plurality of key ways and said second housing comprises one or more keys, said key ways being structured for a plurality of engagement orientations with said keys.

13. The system of claim 12, wherein said first follower bar and said lock plug are stationary with respect to one another.

14. The system of claim 12, wherein said first follower bar has at least one structural end feature matingly engageable with said lock plug.

15. The system of claim 12, further comprising a second follower bar, wherein said second follower bar is interchangeable with said first follower bar.

16. The system of claim 12, further comprising a plurality of top pins housed in said outer casing, and a plurality of bottom pins housed in said lock plug, said outer casing comprising at least a first position with respect to said lock plug wherein said plurality of top pins and said plurality of bottom pins are captured by said outer casing and said lock plug.

17. The system of claim 16, wherein said outer casing comprises at least a second position with respect to said lock plug wherein said plurality of top pins are captured by said outer casing and said first follower bar.

18. The system of claim 16, wherein said outer casing comprises at least a second position with respect to said lock plug wherein said plurality of bottom pins are removable.

19. The fixture of claim 6, wherein the at least one protrusion of the first geometry comprises a circular protrusion, and wherein the at least one protrusion of the second geometry comprises a pair of crescent-shaped protrusions.

* * * * *